US007766988B2

(12) United States Patent
Roberts

(10) Patent No.: US 7,766,988 B2
(45) Date of Patent: Aug. 3, 2010

(54) LINT TRAP LINER

(76) Inventor: Paul L. Roberts, 4390 Bimini Ct. #303-C, Little River, SC (US) 29566

( * ) Notice: Subject to any disclaimer, the term of this patent is extended or adjusted under 35 U.S.C. 154(b) by 533 days.

(21) Appl. No.: 11/804,230

(22) Filed: May 17, 2007

(65) Prior Publication Data

US 2008/0282569 A1 Nov. 20, 2008

(51) Int. Cl.
*D06F 58/22* (2006.01)
*B01D 46/00* (2006.01)

(52) U.S. Cl. ..... 55/385.1; 55/385.4; 55/490; 55/507; 55/495; 55/524; 34/82

(58) Field of Classification Search ..... 55/385.4, 55/385.1, 385.6, 495, 511, 357, 507, 320, 55/524, 490; 34/82, 87, 467, 480
See application file for complete search history.

(56) References Cited

U.S. PATENT DOCUMENTS 3,261,628 A * 7/1966 Kesling ..... 292/70
3,648,381 A 3/1972 Fox
4,115,485 A 9/1978 Genessi
4,653,200 A 3/1987 Werner
4,720,925 A 1/1988 Czech et al.
5,042,170 A 8/1991 Hauch et al.
5,236,478 A 8/1993 Lewis et al.
5,938,141 A * 8/1999 Kanbar ..... 242/423.1
6,481,047 B1 11/2002 Schaefer
7,055,262 B2 6/2006 Goldberg et al.
2004/0205806 A1 * 10/2004 Brown ..... 720/719
2008/0256821 A1 * 10/2008 Jordan ..... 34/82

* cited by examiner

*Primary Examiner*—Duane Smith
*Assistant Examiner*—Tiffany N Palmer
(74) *Attorney, Agent, or Firm*—P. Jeff Martin; The McGougan Law Firm, LLC

(57) ABSTRACT

A disposable filter media removably attachable to a conventional lint trap utilized in automatic clothes dryers is provided. The disposable filter media is in the form of a flexible, lightweight meshed liner adapted for snug, releasable attachment atop the lint collecting surface of a lint trap. The liner functions to provide optimum lint capturing efficiency without an inordinate drop in the air volume in a clothes dryer and is easily removed and disposed of after use.

13 Claims, 5 Drawing Sheets

LINT TRAP LINER

RELATED APPLICATIONS

There are no previously filed, nor currently any co-pending applications, anywhere in the world.

BACKGROUND OF THE INVENTION

1. Field of the Invention

The present invention relates generally to filters and, more particularly, to a disposable liner adapted for removable attachment to a conventional lint trap.

2. Description of the Related Art

Lint traps in domestic and commercial clothes dryers are well known. These devices, particularly utilized in automatic clothes dryers, include lint filtering screens which are positioned in the air flow path downstream of a dryer drum in order that moisture-laden lint entrained in the air stream is filtered therefrom prior to the exhaustion of the air from the dryer apparatus.

Clothes dryer manufacturers generally recommend that lint screens be cleaned preferably after each dryer load, thus requiring lint-laden screens to be laboriously cleaned and frequently replaced. Cleaning necessitates the manual removal of lint from the lint screen which invariably requires numerous attempts due to lint fragmentation and fall-off. However, cleaning of the lint screen is often neglected, thus generating an excessive accumulation of lint on the lint screen. In any event, excessive lint accumulation can impede the normal operation of the clothes dryer. Excessive lint accumulation can further cause lint to rub on the exhaust chute during removal of the screen and fall therefrom into the dryer drum atop a freshly laundered load. Moreover, lint accumulation can cause lint particles to scatter or disperse into the surrounding environment thus inducing respiratory problems and fire hazard.

Accordingly, a need has arisen for a disposable filter media being removably attachable to a conventional lint trap which allows lint to be removed monolithically therefrom in a manner which is quick, easy, and efficient. The development of the lint trap liner fulfills this need.

A search of the prior art did not disclose any patents that read directly on the claims of the instant invention; however, the following references were considered related.

U.S. Pat. No. 4,653,200, issued in the name of Werner discloses a lint screen shield assembly attached to a removable dryer lint screen.

U.S. Pat. No. 6,481,047 B1, issued in the name of Schaefer discloses a vacuum cleaner device for cleaning lint from lint traps of clothes dryers.

U.S. Pat. No. 4,720,925, issued in the name of Czech et al. discloses a lint filter housing for a dryer.

U.S. Pat. No. 5,236,478, issued in the name of Lewis et al. discloses a lint trap unit which emphasizes drastically reduced air flow within the cabinet of the dryer unit preceding an incorporated filter tray, when employed, so as to allow for an effectual precipitation on entrained moisture, lint, and other particles to the bottom of the container.

U.S. Pat. No. 5,042,170, issued in the name of Hauch et al. discloses a lint collecting device particularly suited for use in conventional domestic clothes dryers.

U.S. Pat. No. 3,648,381, issued in the name of Fox discloses a lint trap located on the door of a clothes dryer.

U.S. Pat. No. 4,115,485, issued in the name of Genessi discloses a lint interceptor for separating lint from a stream of air emanating from a clothes dryer.

U.S. Pat. No. 7,055,262 B2, issued in the name of Goldberg et al. discloses a drying apparatus comprising a chamber for containing articles to be dried, means for supplying heated dry air at a first temperature to the chamber, which air supplying means comprises an air flow pathway having means for removing moisture from air exiting the chamber and for decreasing the temperature of the air to below dew point temperature and means for increasing the temperature of the air exiting the moisture removing means to the first temperature, and a heat pump system.

Consequently, a need has been felt for a disposable filter media adapted for removable attachment to a conventional lint trap which allows lint to be removed unitarily therefrom in a manner which is quick, easy, and efficient.

SUMMARY OF THE INVENTION

Therefore, it is an object of the present invention to provide a disposable filter media adapted for removable attachment to a conventional lint trap used in automatic clothes dryers.

It is another object of the present invention to provide a disposable filter media in the form of a flexible, lightweight liner comprised of a meshed membrane adapted for snug, contiguous placement atop the lint collecting surface of a screen web of a lint trap.

It is another object of the present invention to provide a meshed membrane constructed of a material having a mesh size adapted to facilitate optimum lint capturing efficiency without an inordinate drop in the air volume in a clothes dryer.

It is another object of the present invention to provide an integral attachment means adapted to facilitate removable attachment of lint trap liner to lint trap.

It is still another object of the present invention to provide a plurality of linearly aligned lint trap liners which are formed, manufactured, packaged, and provided in a rolled form for ease of dispensing and use.

Briefly described according to one embodiment of the present invention, a lint trap liner is disclosed. The lint trap liner is adapted for removable attachment to a conventional lint trap utilized for filtering lint in automatic clothes dryers. The lint trap liner is adapted for disposable use and forms a generally rectangular configuration having an upper surface or lint contacting surface and a lower surface. The lint trap liner is adapted to capture moist lint from a stream of air exhausted from the air outlets through the exhaust chute of a clothes dryer as lint passes therethrough.

The lint trap liner comprises an elongated, flexible, tenuous meshed membrane adapted for snug, contiguous placement atop the lint collecting surface of a screen web of a lint trap. The meshed membrane is constructed of a material having a porosity or mesh size adapted to facilitate optimum lint capturing efficiency without an inordinate drop in the air volume in the clothes dryer.

An attachment means is provided in order to facilitate removable attachment of lint trap liner to lint trap. The attachment means, according to a first embodiment, comprises a plurality of tabs protruding integrally from a continuous peripheral edge of the meshed membrane. The tabs are bent in a manner so as to fixedly engage the underside of corresponding frame peripheral edge portions, thereby removably attaching liner to the lint collecting surface of screen web in a snug-fit manner.

The attachment means, according to a second embodiment, comprises a plurality of adhesive strips bonded about horizontal and vertical edges of the lint trap liner. Each adhesive strip of the plurality of adhesive strips comprises an adhesive coating bonded to the lower surface of the lint trap liner about a first horizontal edge, a second horizontal edge, a first vertical edge, and a second vertical edge of thereof. The adhesive coating is protected by a releasable liner. The adhesive strips are adapted to releasably hold the liner securely to the front side of the frame of the lint trap.

The attachment means, according to a third embodiment, comprises at least one catch assembly, wherein catch assembly comprises a pair of opposing L-shaped legs molded integral to the lower surface of lint trap liner about the horizontal sidewalls thereof. The L-shaped legs are adapted to snap into engagement with corresponding rectangular projections formed integral to the lint trap frame by a resilient, snap-fit action, thereby removably securing lint trap liner to lint trap.

It is envisioned that a plurality of linearly aligned lint trap liners are formed, manufactured, packaged, and provided in a rolled form for ease of dispensing and use. The lint trap liner is manufactured as a length of a plurality of lint trap liners which are perforated at regular intervals, along perforations. An individual lint trap liner is easily separated from the roll along a perforation, in a manner similar to separating a paper towel from a paper towel roll.

The use of the present invention allows lint to be peelably removed unitarily from a conventional lint trap in a manner which is quick, easy, and efficient. The use of the present invention also eliminates messy cleanup of airborne lint fibers and reduces fire risk.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
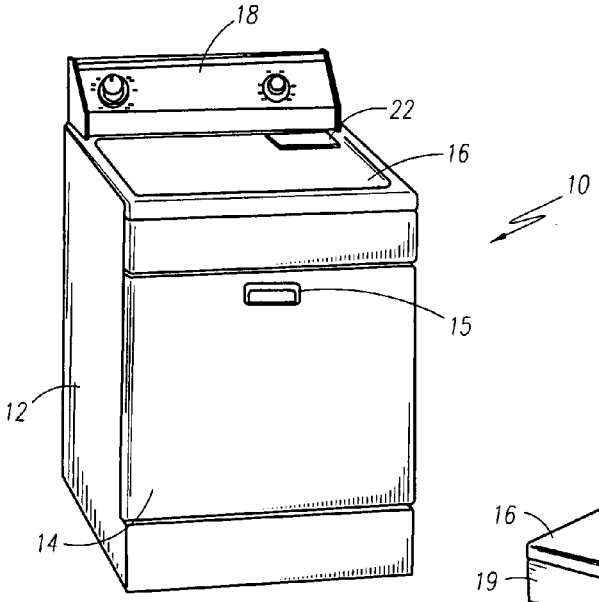
FIG. 1 is a perspective view of a clothes dryer.
Figure 2:
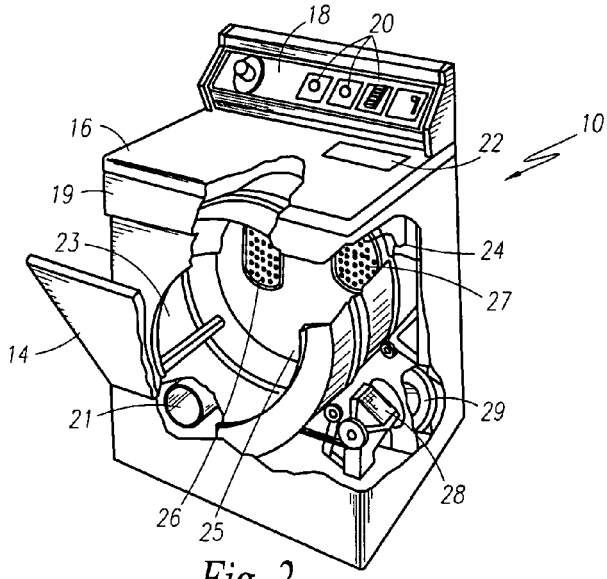
FIG. 2 is a perspective view of a clothes dryer partially cut away to illustrate the interior components thereof.
Figure 3:
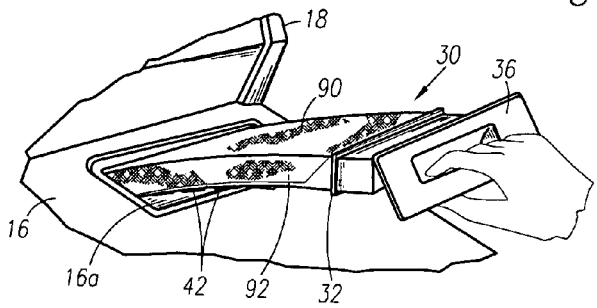
FIG. 3 is a fragmentary view showing a lint trap being removed from the clothes dryer of FIG. 2.
Figure 4:
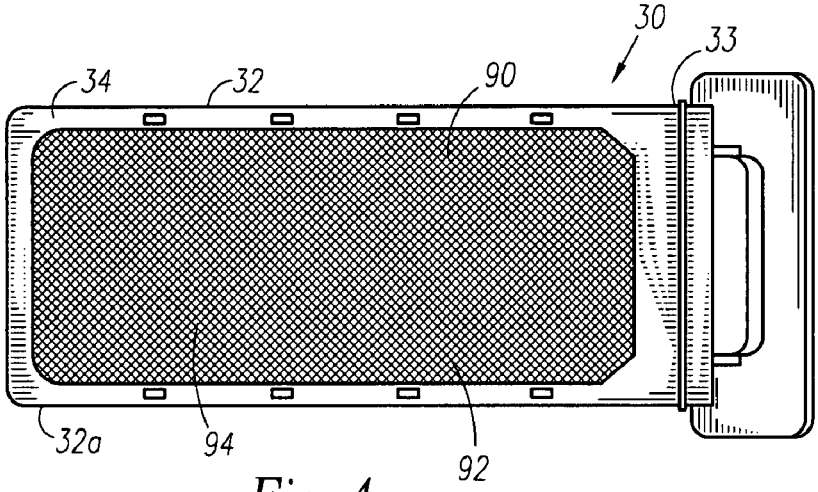
FIG. 4 is a top side view of a conventional lint trap.
Figure 5:
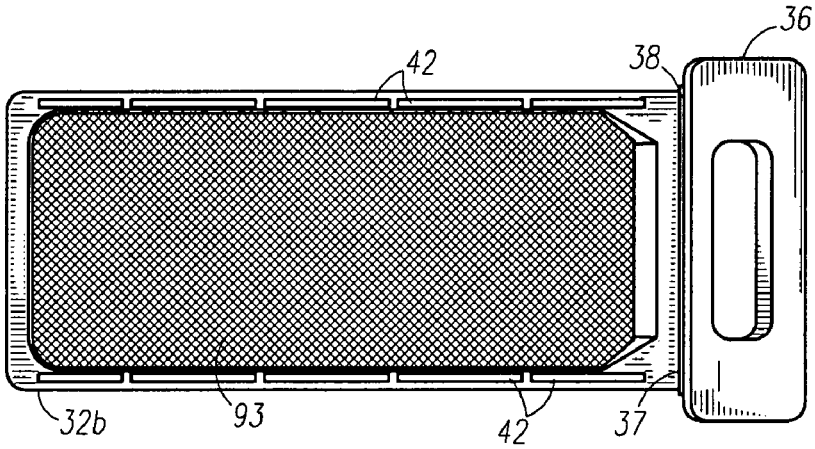
FIG. 5 is a bottom side view of a conventional lint trap.
Figure 6:
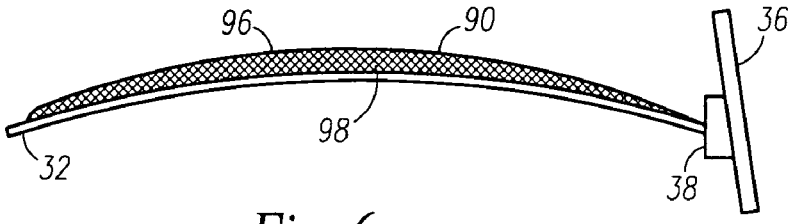
FIG. 6 is a side elevational view of a conventional lint trap.

Referring now to FIGS. 1 and 2, a clothes dryer 10 is shown and described generally as having a housing 12 and a front, openable loading door 14 with a handle 15. The door 14 provides access to the interior of a rotatable drum 23. The rotatable drum 23 rotates about a horizontal axis and has a non-rotating rear bulkhead 25 provided with air inlets 26 and air outlets 27. The air inlets 26 are adapted for loading the interior of rotatable drum 23 with heated air via a heater 21 and the air outlets 27 are adapted for exhausting moisture, lint laden air. The rotatable drum 23 rotates via an electric motor 28 being operatively connected therewith. The electric motor 28 may also drive a fan 29 in order to facilitate airflow through the interior of rotatable drum 23.

The clothes dryer 10 further includes a front wall 19 and a top wall 16 having a control panel 18 at a rear thereof. The control panel 18 includes a plurality of controls 20, a number of which being manually activated to cause the clothes dryer 10 to advance through an automatic series of drying steps. The top wall 16 has a hatch 22 providing access to a lint trap 30, shown in FIGS. 1 and 2. The lint trap 30 is located downstream of the air outlets 27 and is removably held within an exhaust chute 24. The lint trap 30 is inserted and removed from exhaust chute 24 through an opening **16*a* defined in the top wall 16 of clothes dryer 10. The opening 16*a* provides direct passage into the exhaust chute 24**.

Referring now to FIGS. 3-6, the lint trap 30 is shown and described generally as having an elongated frame 32 on which is mounted a screen web 90 for collecting lint 40. The frame 32 includes a front side **32*a*, to which is mounted screen web 90, opposing a rear side 32b. The screen web 90 forms a lint collecting surface 94 on a first side 92 thereof. Screen web 90 includes a second side 93 opposing the first side 92. The screen web 90 may define a concave curvature 96 that forms a recessed cavity 98. The frame 32 further includes an anterior end 33 and a posterior end 34, wherein anterior end 33 defines a neck portion 37 having a handle 36 integrally molded or suitably affixed, such as by a spacer 38, thereto. The frame 32 may include a row of spaced, rectangular projections 42 integrally molded to the rear side 32*b* thereof. The projections 42 add structural rigidity to the frame 32 and spacings between projections 42 allow frame 32** to bend.

Figure 7:
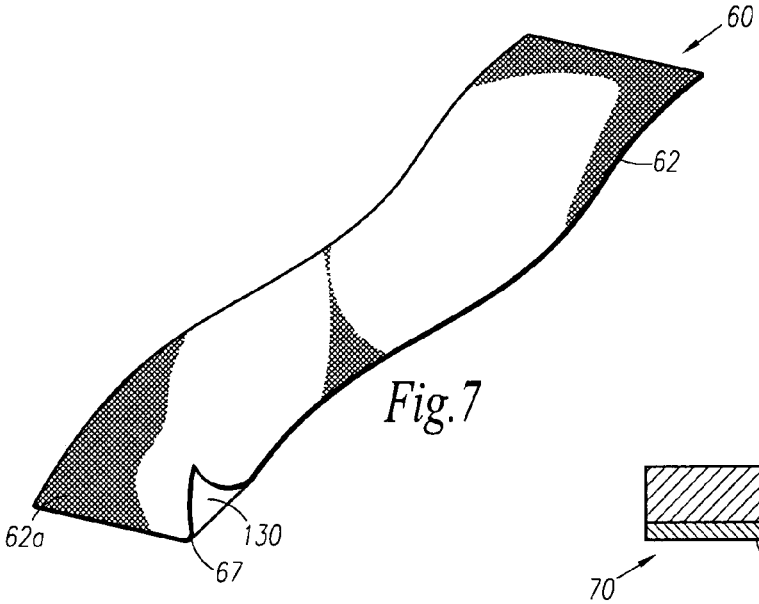
FIG. 7 is a perspective view of the lint trap liner, according to the preferred embodiment of the present invention.
Figure 8:
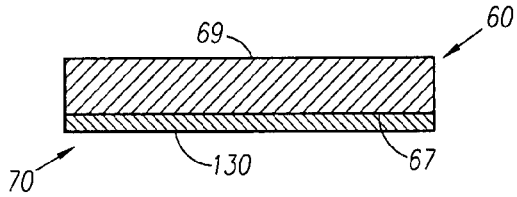
FIG. 8 is a cross-sectional view of the lint trap liner illustrating adhesive bonded to the lower surface thereof, according to the preferred embodiment of the present invention.

Referring now more specifically to FIGS. 7 and 8, a lint trap liner 60 is provided, wherein lint trap liner 60 is adapted for releasable attachment to a lint trap 30. The lint trap liner 60 is adapted for disposable use and forms a generally rectangular configuration having an upper surface or lint contacting surface 69 and a lower surface 67. While lint trap liner 60 is described as having a generally rectangular configuration, other geometric configurations are envisioned in order that lint trap liner 60 may shapely and measurably correspond to lint traps 30 defining various other configurations such as circular, square, oval, and the like. The lint trap liner 60 is adapted to capture moist lint 40 from a stream of air exhausted from the air outlets 27 through the exhaust chute 24 of a clothes dryer 10 as lint 40 passes therethrough. The lint trap liner 60 comprises an elongated, flexible, tenuous meshed membrane 62 adapted for snug, contiguous placement atop the first side 92 or lint collecting surface 94 of screen web 90. The meshed membrane 62 is sizably and flexibly adapted so as to accommodate and readily conform to the contour of the first side 92 of screen web 90. The meshed membrane 62 is sized so as to extend across an entirety of the first side 92 of screen web 90. The meshed membrane 62 is constructed of a material having a porosity or mesh size adapted to facilitate optimum lint capturing efficiency without an inordinate drop in the air volume in the clothes dryer 10. The membrane 62 construction material is adapted to prevent lint 40 fibers from dissociating, scattering or dispersing from atop the lint contacting surface 69 once accumulated thereon. It is envisioned that meshed membrane 62 is fabricated of a high temperature-resistant, flexible media selected from the group which includes but is not limited to monofilament open mesh fabric, fiberglass mesh media, polyethylene and polypropylene blend mesh media, aluminum mesh, and electrostatic mesh media. Monofilament open mesh fabrics comprise polypropylene monofilament fabric and polyester monofilament fabric. The meshed membrane 62 has a porosity or mesh size ranging from about 1 to 1000 microns.

An attachment means 70 is provided in order to facilitate releasable attachment of lint trap liner 60 to lint trap 30. The attachment means 70, according to the preferred embodiment, comprises a thin film of adhesive 130 bonded to the lower surface 67 of the lint trap liner 60, wherein adhesive 130 is bonded or suitably applied to lower surface 67 in such a manner so as to leave meshed openings 62*a* of liner 60 uncovered. The adhesive 130 is a pressure-sensitive adhesive further defined as a releasable bond adhesive. More specifically, the adhesive 130 is comprised a formulation having a degree of tackiness sufficient to hold the liner 60 securely to the front side 32*a* of frame 32 in addition to secure snug-fit engagement by liner 60 with the first side 92 of screen web 90, but which also allows liner 60 to be peelably released unitarily or monolithically from lint trap 30 without tearing, ripping, splitting, or the like. The adhesive formulation also provides sufficient tackiness to ensure against undesirable liner 60 release from lint trap 30 as lint trap 30 is inserted, temporarily positioned inside, and removed from exhaust chute 24.

Figure 9:
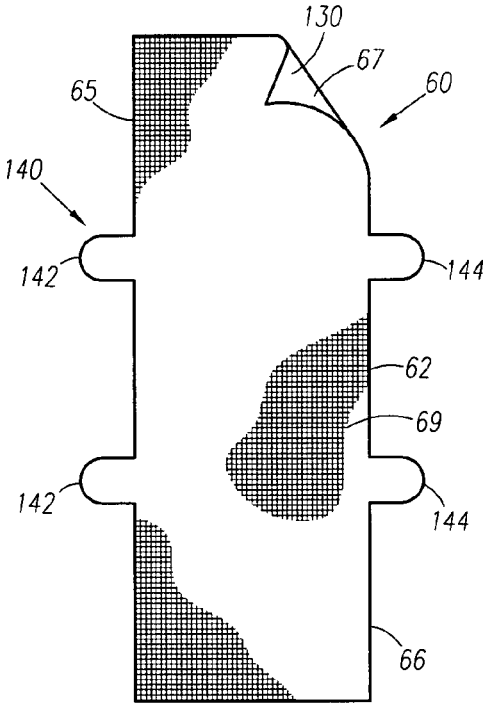
FIG. 9 is a top plan view of the lint trap liner illustrating the concave protrusions thereof.
Figure 10:
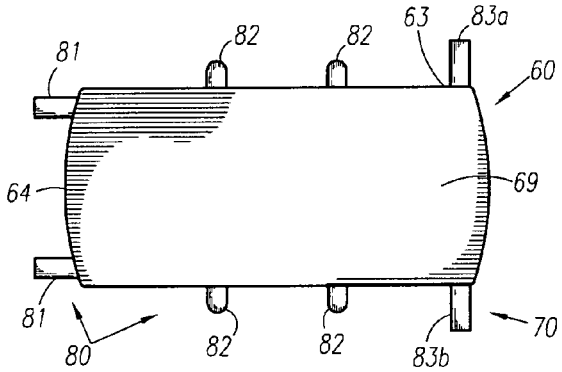
FIG. 10 is a top plan view of a lint trap liner, according to a first alternative attachment means.

It is envisioned that liner 60 may include a plurality of integral concave protrusions 140 extending outwardly from a continuous peripheral edge of meshed membrane 62, as shown in FIG. 9. More specifically, a first pair of protrusions 142, being spatially positioned, extend outward laterally from a horizontally-oriented peripheral edge 65 of liner 60, while a second pair of protrusions 144, being spatially positioned, extend outward laterally from an opposing horizontally-oriented peripheral edge 66 of liner 60. The protrusions 142, 144 are formed in a symmetric, curvilinear manner. Such liner 60 embodiment includes, as described above, a thin film of adhesive 130 bonded to the lower surface 67 of the lint trap liner 60, wherein adhesive 130 is bonded or applied to lower surface 67 in such a manner so as to leave meshed openings 62*a* of liner 60 uncovered. The lower surface 67 of liner 60 is aligned with and releasably bonded to the first side 92 of screen web 90. The first and second pair of protrusions 142 and 144 are folded against corresponding, opposing longitudinal sides 35, 39 of frame 32 along the underside 32*b* thereof. The protrusions 142 and 144 are adapted to conform readily to and be releasably held against opposing longitudinal sides 35, 39 of frame along the underside 32*b* thereof, thereby releasably bonding liner 60 in a snug-fit, conformational manner to lint trap 30.

Referring now to FIGS. 10-13, an attachment means 70, in another embodiment, comprises a plurality of tabs 80 protruding integrally from a continuous peripheral edge of meshed membrane 62. More specifically, a first set of tabs 81 protrude perpendicularly from a vertically-oriented lower peripheral edge 64 of liner 60, while a second set of tabs 82 protrude perpendicularly from opposing horizontally-oriented peripheral edges 65,66 of liner 60. A proximal peripheral edge 63 of liner 60 includes opposing tabs 83*a*, 83*b* protruding perpendicularly therefrom. Tabs 83*a*, 83*b* protruding along the proximal peripheral edge 63 of liner 60 define a greater length than a length defining remaining tabs 81 and 82.

The plurality of tabs 80 are constructed of a resilient, flexible material adapted to bend to a shaped curvature and maintain the shaped curvature in its existing state until manually straightened, bent, or reshaped to an alternative configuration. In use, once liner 60 is properly aligned and placed atop the screen web 90, the tabs 80 are bent in a manner so as to fixedly engage the underside 32b of corresponding frame 32 peripheral edge portions, thereby removably attaching liner 60 to the first side 92 of screen web 90 in a snug-fit manner. More specifically, tabs 81 are adapted to bend and fixedly engage the posterior end 34 of frame 32 along the underside 32*b* peripheral edge thereof. Tabs 82 are adapted to bend and fixedly engage corresponding, opposing longitudinal sides 35, 39 of frame 32 along the underside 32*b* thereof. Tabs 83*a* and 83*b* are adapted to bend and fixedly engage the anterior end 33 of frame 32 along the underside 32*b* peripheral edge thereof.

Figure 11:
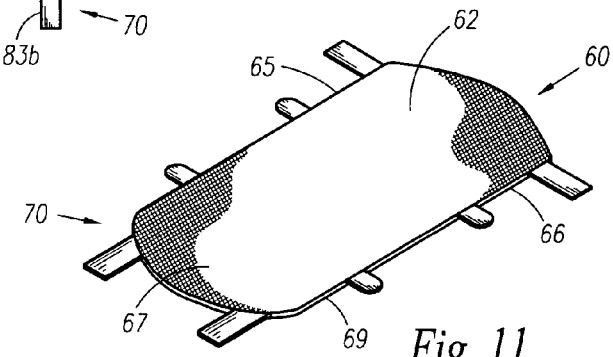
FIG. 11 is a bottom plan view of the lint trap liner, according to the first alternative attachment means.
Figure 12:
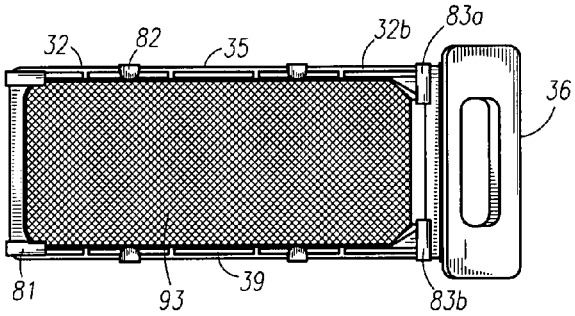
FIG. 12 is a bottom side perspective view of a lint trap showing the lint trap liner removably attached thereto, according to the first alternative attachment means.
Figure 13:
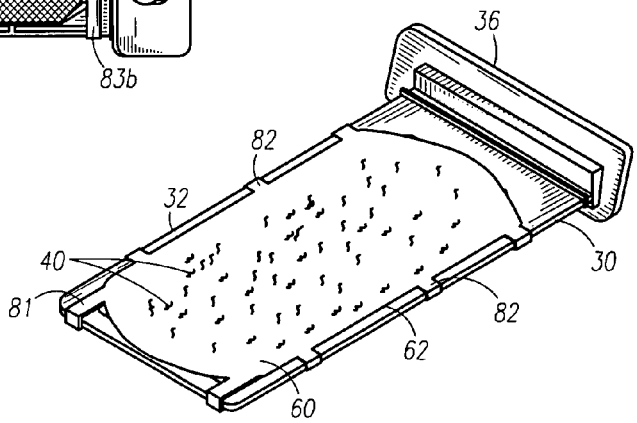
FIG. 13 is a top side perspective view of the lint trap depicted in FIG. 12 showing the lint trap liner removably attached thereto, according to the preferred embodiment of the present invention.
Figure 14:
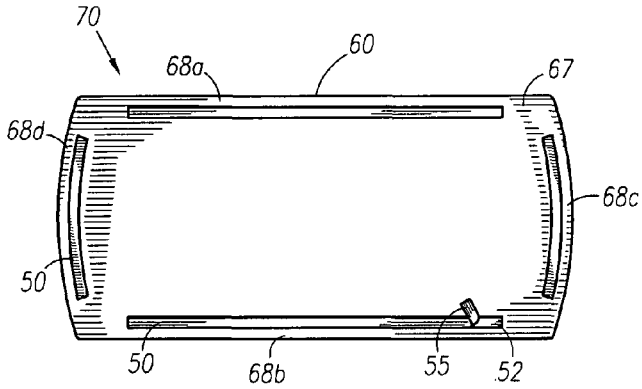
FIG. 14 illustrates a second alternative attachment means.

Referring to FIG. 11, the attachment means 70, in another embodiment, comprises a plurality of adhesive strips 50 bonded about horizontal and vertical edges of the lint trap liner 60. More specifically, each adhesive strip 50 of the plurality of adhesive strips 50 comprises an adhesive coating 52 bonded to the lower surface 67 of the lint trap liner 60 about a first horizontal edge 68*a*, a second horizontal edge 68*b*, a first vertical edge 68*c*, and a second vertical edge 68*d* of thereof. The adhesive coating 52 is a pressure-sensitive adhesive which is protected by a releasable liner 55. The adhesive strips 50 are defined of a formulation having a degree of tackiness sufficient to hold the liner 60 securely to the front side 32*a* of frame 32, thereby ensuring snug-fit engagement by liner 60 with the first side 92 of screen web 90, but which also allows liner 60 to be peelably removed unitarily or monolithically from lint trap 30 without tearing, ripping, or the like. The adhesive formulation also provides sufficient tackiness to ensure against undesirable liner 60 release from lint trap 30 as lint trap 30 is inserted, temporarily positioned inside, and removed from exhaust chute 24.

Figure 15:
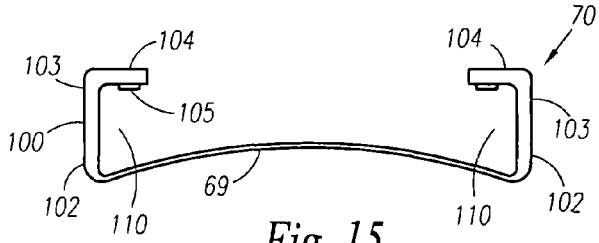
FIG. 15 illustrates a third alternative attachment means.

Referring now to FIG. 15, the attachment means 70, in still another embodiment, comprises at least one catch assembly 100, wherein catch assembly 100 comprises a pair of opposing L-shaped legs 102 molded integral to the lower surface 67 of lint trap liner 60 about the horizontal sidewalls 68*a* and 68*b* thereof. The L-shaped legs 102 each includes a vertical member 103 having a foot portion 104 extending angularly from a lower end thereof at approximately 90°. The L-shaped legs 102 are linearly aligned and each comprises a boss 105 projecting downwardly from the foot portion 104 thereof. The boss 105 forms a projection receiving cavity 110 adapted to frictionally receive a corresponding rectangular projection 42 of the lint trap frame 32 in a snap-fit manner. The L-shaped legs 102 are adapted to snap into engagement with corresponding rectangular projections 42 of the lint trap frame 32 by a resilient, snap-fit action, thereby removably securing lint trap liner 60 to lint trap 30. More specifically, the lower surface 67 of lint trap liner 60 is engaged against the first side 92 of screen web 90 and the L-shaped legs 102 of liner 60 are snapped into engagement with corresponding rectangular projections 42 of frame 32.

It is envisioned other attachment mechanisms and methods such as hook and loop fasteners may be utilized to facilitate removable attachment of lint trap liner 60 to lint trap 30.

Figure 16:
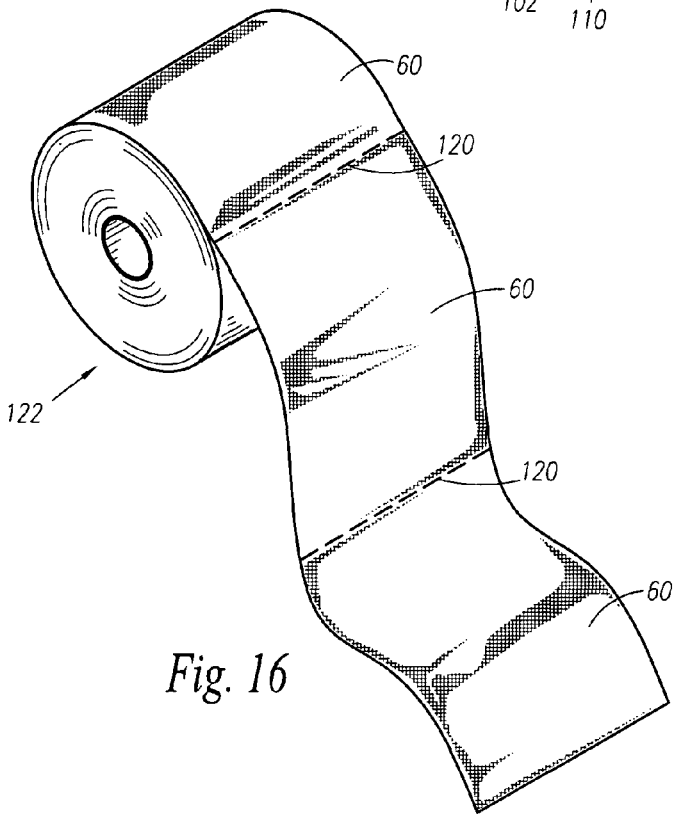
FIG. 16 is a perspective view of a plurality of the lint trap liner depicted in FIG. 14, positioned into a roll with perforations at regular intervals to provide individual lint trap liners adapted to be separated from the roll.

Referring now to FIGS. 7-14, and more particularly to FIG. 16, as will be described in greater detail below, it is envisioned in another embodiment that a plurality of linearly aligned lint trap liners 60 are formed, manufactured, packaged, and provided in a rolled form 122 for ease of dispensing and use. For purposes of disclosing the best available mode concerning this embodiment, and not by way of limitation regarding the functionality or design of the present invention, the lint trap liner 60 is manufactured as a length of a plurality of lint trap liners 60 which are perforated at regular intervals, along perforations 120. An individual lint trap liner 60 is easily separated from the roll 122 along a perforation 120, in a manner similar to separating a toilet tissue from a toilet tissue roll (not shown) or a paper towel from a paper towel roll (not shown). The perforations 120 may include any combination of short and long scores 124 or slits separated by short and long portions of lint trap liner 60 material. Scores 124 or slits are intended to include indentations in the lint trap liner 60 material which do not penetrate completely therethrough.

Each liner 60 comprises a flexible, tenuous meshed membrane 62 adapted for releasable attachment to a lint trap 30. The membrane 62 has a lint contacting surface 69 opposing a lower surface 67 and is otherwise defined as being substantially identical to the lint trap liner 60 as described above according to the preferred embodiment of the present invention. It is envisioned, however, that this embodiment may also comprise membranes 62 each having a plurality of integral concave protrusions 140 extending outwardly from a continuous peripheral edge thereof, as described above in greater detail.

In order to facilitate releasable attachment of an individual lint trap liner 60 to the lint trap 30, an attachment means 70 is provided. For purposes of describing this embodiment, the attachment means 70 comprises a thin film of adhesive 130 bonded to the lower surface 67 of membrane 62, as described above according to the preferred embodiment, but may comprise alternative attachment means 70 as also described in detail above. The attachment means 70 is adapted to facilitate releasable attachment of each individual membrane 62 to the lint trap 30.

Alternative storage and dispensing configurations are contemplated. The liner 60 is further envisioned to be commercially available in the form of pre-measured sheets of uniform or non-uniform dimensions adapted to be stacked upon one another in a desired successional arrangement and dispensed from a suitable dispensing apparatus, such as a box or carton.

The use of the present invention allows for lint 40, having accumulated on the meshed media which is attached superjacent to a lint trap 30, to be peelably removed unitarily from lint trap 30 in a quick, easy, and efficient manner. The lint-accumulation and adherence feature of the present invention also prevents lint 40 or lint particles from scattering into the surrounding environment and falling onto the clothes dryer 10 or a clothes load during removal of the lint trap 30 with attached liner 60.

2. Operation of the Preferred Embodiment

To use the present invention, user removably attaches the lint trap liner 60 to the lint collecting surface 94 of the screen web 90 of a lint trap 30 in a superjacent manner using the attachment means 70. User next inserts the lint trap 30 with attached lint trap liner 60 through the exhaust chute 24 of a clothes dryer 10 in a manner such that the lint contacting surface 69 of liner 60 faces downwardly. User then executes a number of automatic clothes drying loads until a quantity of lint 40 has accumulated atop the lint contacting surface 69 of liner 60 requiring the lint trap 30 with attached liner 60 to be removed for cleaning. User then peelably removes lint-laden liner 60 from lint trap 30 and properly disposes of liner 60. The lint trap liner 60 is adapted to peel unitarily from the lint trap 30.

The use of the present invention allows lint to be peelably removed unitarily from a conventional lint trap in a manner which is quick, easy, and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A lint trap liner comprising:

a flexible, tenuous meshed membrane releasably attachable to a lint trap, said membrane having a lint contacting surface opposing a lower surface; and an attachment means, said attachment means comprises a thin film of adhesive bonded to said lower surface of said membrane, said adhesive is bonded or suitably applied to said lower surface in such a manner so as to leave meshed openings of said membrane uncovered, said attachment means allows for releasable attachment of said membrane to the lint trap, wherein said attachment means comprises a plurality of tabs protruding integrally from a continuous peripheral edge of said membrane, wherein said plurality of tabs includes a first set of tabs protruding perpendicularly from a vertically-oriented lower peripheral edge of said membrane and a second set of tabs protruding perpendicularly from opposing horizontally-oriented peripheral edges of said membrane, said membrane having a proximal peripheral edge with opposing tabs protruding perpendicularly therefrom, and wherein said opposing tabs protruding along the proximal peripheral edge of said membrane define a greater length than a length defining said first set of tabs and said second set of tabs.

2. The lint trap liner of claim 1, wherein said plurality of tabs are constructed of a resilient, flexible material adapted to bend to a shaped curvature and maintain the shaped curvature in its existing state until manually straightened, bent, or reshaped to an alternative configuration, and wherein said membrane is properly aligned and engaged atop the screen web of the lint trap and said plurality of tabs are bent in a manner so as to fixedly engage the underside of a corresponding frame peripheral edge portions, thereby removably attaching said membrane to the first side of the screen web in a snug-fit manner.

3. A lint trap liner comprising:

a flexible, tenuous meshed membrane releasable attachable to a lint trap, said membrane having a lint contacting surface opposing a lower surface; and an attachment means, said attachment means comprises at least one catch assembly, wherein each said catch assembly comprises a pair of opposing L-shaped legs molded integral to said lower surface of said membrane about a horizontal sidewalls thereof, wherein said L-shaped legs each includes a vertical member having a foot portion extending angularly from a lower end thereof at approximately 90°, said L-shaped legs are linearly aligned and each comprises a boss projecting downwardly from said foot portion thereof, said bois forms a projection receiving cavity adapted to frictionally receive a corresponding rectangular projection of the frame of the lint trap in a snap-fit manner, said L-shaped legs are adapted to snap into engagement with the corresponding rectangular projections of the frame of the lint trap by a resilient, snap-fit action, thereby removably securing said membrane to the lint trap.

4. The lint trap liner of claim 3, wherein said catch assembly is two in number.

5. A lint trap liner comprising:

an elongated flexible, tenuous meshed membrane adapted for releasable attachment to a lint trap, said membrane having a lint contacting surface opposing a lower surface, said membrane includes a plurality of integral concave protrusions extending outwardly from a continuous peripheral edge of said membrane, said plurality of integral concave protrusions are formed in a symmetric, curvilinear manner; and an attachment means, said attachment means comprises a thin film of adhesive bonded to said lower surface of said membrane, said attachment means is adapted to facilitate releasable attachment of said membrane to the lint trap, said attachment means comprises a thin film of adhesive bonded to said lower surface of said membrane, wherein said adhesive is bonded or suitably applied to said lower surface in such a manner so as to leave meshed openings of said membrane uncovered.

6. The lint trap liner of claim 5, wherein said plurality of integral concave protrusions comprises a first pair of protrusions and a second pair of protrusions, said first pair of protrusions and said second pair of protrusions are folded against corresponding, opposing longitudinal sides of the frame of the lint trap along the underside thereof, said first pair of protrusions and said second pair of protrusions are adapted to conform readily to and be releasably held against the opposing longitudinal sides of the frame of the lint trap along the underside thereof, thereby releasably bonding said membrane to the lint trap in a snug-fit, conformational manner.

7. A plurality of linearly aligned, rolled lint trap liners adapted for disposable use, where each said roll of liners is comprised of a plurality of lint trap liners perforated at regular intervals so as to form individual liner elements, each said liner element being easily separated from said roll along a perforation, each said liner element comprising:

a flexible, tenuous meshed membrane adapted for releasable attachment to a lint trap, said membrane having a lint contacting surface opposing a lower surface, said membrane is sizably and flexibly adapted so as to accommodate and readily conform to a contour of a first side of a screen web of the lint trap, said membrane is sized so as to extend across an entirety of the first side of the screen web, and wherein said membrane is constructed of a high temperature-resistant, flexible media having a porosity or mesh size adapted to facilitate optimum lint capturing efficiency without an inordinate drop in the air volume in a clothes dryer; and an attachment means, said attachment means comprises a thin film of adhesive bonded to said lower surface of said membrane, said attachment means is adapted to facilitate releasable attachment of said membrane to the lint trap.

8. A lint trap liner comprising:

a flexible, tenuous meshed membrane releasably attachable to a lint trap, said membrane having a lint contacting surface opposing a lower surface; and an attachment means, said attachment means comprises a thin film of adhesive bonded to said lower surface of said membrane, said attachment means allows for releasable attachment of said membrane to the lint trap, said attachment means comprises a thin film of adhesive bonded to said lower surface of said membrane, said adhesive is bonded or suitably applied to said lower surface in such a manner so as to leave meshed openings of said membrane uncovered, said adhesive is a pressure-sensitive adhesive, wherein said adhesive comprises a formulation having a degree of tackiness sufficient to securely hold said membrane to a front side of a frame of the lint trap and to provide for snug-fit engagement by said membrane with the first side of the screen web, and wherein said adhesive is further adapted to allow said membrane to be peelably released unitarily from the lint trap without tearing, splitting, or ripping.

9. The lint trap liner of claim 8, wherein said membrane is sizably and flexibly adapted so as to accommodate and readily conform to a contour of a first side of a screen web of the lint trap, said membrane is sized so as to extend across an entirety of the first side of the screen web.

10. The lint trap liner of claim 8, wherein said membrane is constructed of a material having a porosity or mesh size adapted to facilitate optimum lint capturing efficiency without an inordinate drop in the air volume in a clothes dryer.

11. The lint trap liner of claim 9, wherein said membrane is fabricated of a high temperature-resistant, flexible media.

12. The lint trap liner of claim 9, wherein said membrane is defined generally of an elongated, rectangular configuration and is adapted for disposable use.

13. The lint trap liner of claim 8, wherein said thin film of adhesive comprises a plurality of adhesive strips bonded about horizontal and vertical edges of said lower surface of said membrane.

* * * * *